US008905860B2

(12) United States Patent
Fitchett et al.

(10) Patent No.: US 8,905,860 B2
(45) **Date of Patent: *Dec. 9, 2014**

(54) BALL INCORPORATING COVER SEPARATION ELEMENT

(75) Inventors: Derek A. Fitchett, Beaverton, OR (US); Arthur P. Molinari, Beaverton, OR (US); Jung Gyu Moon, Ansan (KR)

(73) Assignee: NIKE, Inc., Beaverton, OR (US)

( * ) Notice: Subject to any disclaimer, the term of this patent is extended or adjusted under 35 U.S.C. 154(b) by 293 days.

This patent is subject to a terminal disclaimer.

(21) Appl. No.: 13/405,749

(22) Filed: Feb. 27, 2012

(65) Prior Publication Data

US 2013/0225322 A1 Aug. 29, 2013

(51) Int. Cl.
*A63B 37/04* (2006.01)
*A63B 37/00* (2006.01)

(52) U.S. Cl.
CPC ..... *A63B 37/0037* (2013.01)
USPC ..... 473/374; 473/351; 473/377; 473/409

(58) Field of Classification Search
USPC ..... 473/409, 371, 280, 352, 374
See application file for complete search history.

(56) References Cited

U.S. PATENT DOCUMENTS 1,533,563 A * 4/1925 Maggi ..... 264/36.12
2,079,615 A * 5/1937 Holt et al. ..... 427/140
3,233,544 A * 2/1966 Hosoya ..... 102/334
3,268,634 A * 8/1966 Glaser ..... 264/36.12
4,614,340 A * 9/1986 Hosoya ..... 473/376
5,098,104 A * 3/1992 Kane ..... 473/372
5,389,169 A * 2/1995 McRae ..... 156/98
5,390,932 A * 2/1995 Russo, Sr. ..... 473/377
5,427,377 A * 6/1995 Maruoka ..... 473/377
5,569,418 A * 10/1996 Russo, Sr. ..... 264/36.12
5,609,535 A * 3/1997 Morgan ..... 473/409
5,688,192 A * 11/1997 Aoyama ..... 473/374
5,823,889 A * 10/1998 Aoyama ..... 473/374
5,823,891 A * 10/1998 Winskowicz ..... 473/378
5,913,736 A * 6/1999 Maehara et al. ..... 473/360
5,938,544 A * 8/1999 Winskowicz ..... 473/378
5,961,401 A * 10/1999 Masutani et al. ..... 473/374
5,976,430 A * 11/1999 Kataoka et al. ..... 264/36.12
6,186,906 B1 * 2/2001 Sullivan et al. ..... 473/351
6,210,293 B1 * 4/2001 Sullivan ..... 473/374
6,270,429 B1 * 8/2001 Sullivan ..... 473/374
6,277,037 B1 * 8/2001 Winskowicz et al. ..... 473/378
6,358,160 B1 * 3/2002 Winskowicz ..... 473/378
6,595,875 B1 * 7/2003 Oh ..... 473/374
6,623,382 B2 * 9/2003 Winskowicz ..... 473/378
6,833,098 B2 * 12/2004 Watabe et al. ..... 264/139
7,056,230 B2 * 6/2006 Emalfarb ..... 473/351
7,204,290 B2 * 4/2007 Watabe et al. ..... 156/750
7,244,193 B2 * 7/2007 Emalfarb ..... 473/351
7,967,702 B2 * 6/2011 Winskowicz et al. ..... 473/378

(Continued)

*Primary Examiner* — Gene Kim
*Assistant Examiner* — Matthew B Stanczak
(74) *Attorney, Agent, or Firm* — Honigman Miller Schwartz and Cohn, LLP; Anna M. Budde; Johnatham P. O'Brien

(57) ABSTRACT

A ball includes a core, a cover, and an intermediate layer between the core and the cover. The intermediate layer may be deformed or actuated to create discontinuities in the cover. The creation of discontinuities allows for easier recycling of the ball parts. The intermediate layer may include one of a bladder or a hydrophilic material that expand upon the introduction of a fluid, a shape memory polymer that deforms upon application of a stimulus, or two materials that react chemically to form a gas.

3 Claims, 5 Drawing Sheets

(56) References Cited

U.S. PATENT DOCUMENTS

| | | | | |
|---|---|---|---|---|
| 8,475,297 | B2 * | 7/2013 | Chou et al. | 473/371 |
| 8,479,796 | B2 * | 7/2013 | Ono | 156/760 |
| 8,480,516 | B2 * | 7/2013 | Cheng et al. | 473/409 |
| 8,647,467 | B2 * | 2/2014 | Molinari | 156/711 |
| 2001/0039219 | A1 * | 11/2001 | Sullivan | 473/374 |
| 2002/0056932 | A1 * | 5/2002 | Watabe et al. | 264/36.12 |
| 2002/0094885 | A1 * | 7/2002 | Finkel | 473/351 |
| 2004/0077435 | A1 * | 4/2004 | Matroni et al. | 473/378 |
| 2004/0209701 | A1 * | 10/2004 | Finkel | 473/280 |
| 2005/0227789 | A1 * | 10/2005 | Winskowicz et al. | 473/378 |
| 2006/0234812 | A1 * | 10/2006 | Ladd et al. | 473/371 |
| 2009/0221386 | A1 * | 9/2009 | Ladd et al. | 473/374 |
| 2012/0046126 | A1 * | 2/2012 | Chou et al. | 473/374 |
| 2012/0094785 | A1 * | 4/2012 | Cheng et al. | 473/409 |
| 2012/0231899 | A1 * | 9/2012 | Alan | 473/377 |
| 2012/0266433 | A1 * | 10/2012 | Ono | 29/426.5 |
| 2013/0165267 | A1 * | 6/2013 | Molinari | 473/377 |
| 2013/0225322 | A1 * | 8/2013 | Fitchett et al. | 473/368 |

* cited by examiner

BALL INCORPORATING COVER SEPARATION ELEMENT

FIELD

The present disclosure relates generally to a ball that incorporates a core, a cover, and an intermediate layer. More specifically, the present disclosure relates generally to a ball that incorporates at least one element in an intermediate layer that is capable of increasing an effective thickness of the intermediate layer, thereby facilitating the separation of the cover and core from one another.

BACKGROUND

It is desirable to recycle materials that still have useful life. Golf ball cores are typically made from materials that do not deteriorate as quickly as the covers which surround them. However, when the covers become scuffed, cut, or otherwise deteriorate, many golfers discard the balls and use a new ball for a more predictable performance.

However, only the cover has deteriorated in many instances, and the cores can be recovered and reused or the materials in the cores may be recycled in other ways. In some cases, the core may simply be recovered and reused in the same form and shape. In other cases, the core material or materials may be ground or otherwise reconditioned and combined with other such materials and reused. In some cases, the materials may be reconditioned to be formed into another ball core. In other cases, the materials may be recycled to be used for other purposes.

In many cases, the cover and the core are made from different materials that are joined together. Frequently, an adhesive is used to ensure that the core and the cover remain in fixed relationship to one another. However, the use of such an adhesive creates difficulty in recycling.

The use of an adhesive creates two separate problems. First, the adhesive makes it difficult to separate the cover and the core. Also, the adhesive needs to be removed from both the cover and the core in order to recycle either or both materials. These two difficulties create a relatively high expense to recycle ball materials, which reduces the economic feasibility of doing so.

Accordingly, it is desirable to develop a ball where the cost to recycle the ball is minimized. If a ball design eases the difficulty in separating the core and cover, eases the removal of the adhesive from one or more of the materials, or both, the recycling cost is minimized, which enhances the desire and ability for golfers and manufacturers to recycle balls. The development of a ball that incorporates a material or layer to enable such recycling is desirable.

SUMMARY

In one embodiment, a ball includes a core, a cover, and an intermediate layer. The cover may be disposed radially outwardly of the core. The intermediate layer may be disposed between at least a portion of the cover and at least a portion of the core. The intermediate layer may have a rest configuration with a rest configuration thickness and an actuated configuration with an actuated configuration thickness. The intermediate layer may be changed from the rest configuration thickness to the actuated configuration thickness by mechanical or chemical transformation.

In another embodiment, a layered article includes an innermost layer, an intermediate layer, and an outermost layer. The outermost layer may be radially outward of the innermost layer. The intermediate layer may be disposed between at least a portion of the innermost layer and a corresponding portion of the outermost layer. Deformation of the intermediate layer may enhance separation of the innermost layer and the outermost layer. Deformation of the intermediate layer may occur through chemical or mechanical methods.

In another embodiment, a method of preparing a golf ball for recycling may include the steps of providing a golf ball and deforming an intermediate layer. The golf ball may have at least one core layer, at least one cover layer, and at least one intermediate layer between at least a portion of the at least one core layer and a corresponding portion of the at least one cover layer. The deformation of the intermediate layer may minimize the effort required to remove the at least one cover layer from the at least one core layer.

The present embodiments disclose a structure and method that may be used to reduce the cost and effort required to recycle one or more golf ball layers. The cost and effort may be reduced when the various layers may be separated with greater ease. Because various golf ball layers are made from different materials, they typically cannot be recycled together. When the layers may be easily separated, they may be more easily recycled separate from one another. Often, the core of the golf ball is the most recyclable, and what is desirable is to separate the core from the remaining layers, particularly the cover.

Accordingly, an intermediate layer may be interposed between the core and the cover. The intermediate layer is configured to separate the core from the cover in whole or in part to reduce the effort necessary to separate the layers. The intermediate layer may be deformed or activated by another force or material, such as a temperature change or the introduction of a fluid. This deformation or activation may separate the core and the cover.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
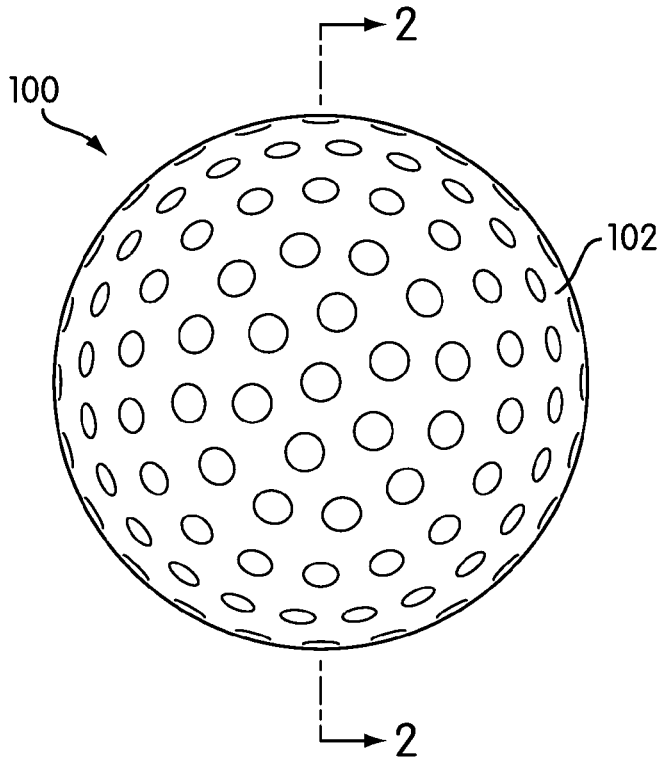
FIG. 1 is a side view of a ball according to the present disclosure.

FIG. 1 is a side view of a ball 100 that may be used in accordance with the embodiments disclosed herein. FIG. 1 shows a generic dimple pattern applied to outer surface 102 of ball 100. While the dimple pattern on ball 100 may affect the flight path of ball 100, no specific dimple pattern is critical to the use of the disclosed embodiments. A designer may select from any appropriate dimple pattern to be applied to ball 100.

Figure 2:
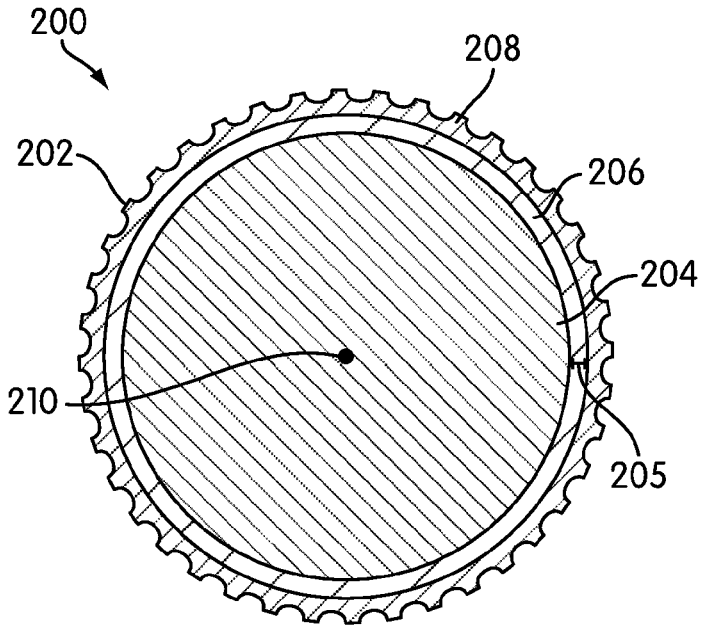
FIG. 2 is a cross-section of the ball of FIG. 1 taken along line 2-2 showing an intermediate layer in a first configuration.

FIG. 2 is a cross-sectional view of a ball 200. Ball 200 may have three layers. The innermost layer may be core 204. Surrounding and disposed radially outwardly from core 204 may be intermediate layer 206. Surrounding and disposed radially outwardly from intermediate layer 206 may be the outermost layer or cover 208.

FIG. 2 shows the cross section in simplified form. A person having ordinary skill in the art is aware that in golf ball or other applications, core 204 may have a plurality of layers. For example, core 204 may have an inner core layer, an outer core layer, and an intermediate core layer between the inner core layer and the outer core layer. In addition, cover 208 may have a plurality of layers. For example, cover 208 may include an inner cover layer, an outer cover layer, and an intermediate cover layer. In other examples, core 204 and/or cover 208 may each have two layers, four layers, or any other number of layers thought desirable by a person having ordinary skill in the art. Core 204 and cover 208 need not have the same number of layers. In addition, in some instances, a top coat, printed indicia, or the like, may be applied to cover 208 and may be considered to be a part of cover 208.

FIG. 2 is also simplified in its reference to the layers that are positioned on either side of intermediate layer 206. In the present disclosure, the layers that are positioned between centerpoint 210 of ball 200 and intermediate layer 206 may be referred to as the core. Also in the present disclosure, the layers that are positioned between the outer surface 202 of ball 200 may be referred to as the cover. However, intermediate layer 206 need not be positioned between what a person having ordinary skill in the art would term the "core" and the "cover." One of the reasons the devices and methods disclosed herein may be used is to ease the separation of a ball, golf ball, or other layered article into two parts. Among the reasons this separation may be desirable is if one or more of the layers is to be treated different from others of the layers. For example, in some instances, the material used to form one or more layers of a golf ball core may be recycled, while the material used to form the outermost cover layer may not be recycled or may be recycled in a different method or way. However, with some balls or layered articles, it may be that it is most advantageous for the intermediate layer to fall between two of the core layers or two of the cover layers, as in some instances, it may be that only, for example, the innermost core layer is treated differently from the remaining layers, and that therefore, it is most desirable to separate this one layer from the remaining layers. Accordingly, when this disclosure refers to or illustrates the intermediate layer being positioned between the core and the cover, it is to be understood that the position of such an intermediate layer may be between any two layers of the golf ball outside of the innermost core layer and inside the outermost cover layer, depending on the various materials used for each layer and the desires of a particular designer. The description and illustration of a single core layer and single cover layer are used merely for ease of description, illustration, and understanding.

Figure 3:
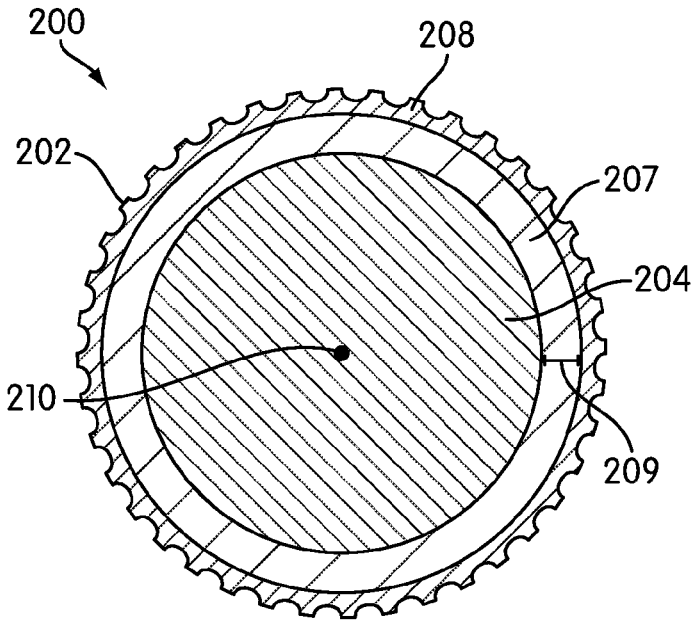
FIG. 3 is a cross-section of the ball of FIG. 1 taken along line 2-2 showing an intermediate layer in a second configuration.

A comparison between FIG. 2 and FIG. 3 illustrates one example of the use of an intermediate layer in accordance with these embodiments. In FIG. 2, intermediate layer 206 is shown in a first position or configuration. The first position shown may be considered to be a rest position or a rest configuration. This first or rest position is the position of intermediate layer 206 as it may be desirable for a golfer to use during play. Intermediate layer 206 may be very thin, so as to contribute as little as possible to the play characteristics of ball 200. Accordingly, in the first position illustrated in FIG. 2, intermediate layer 206 may have a first or rest thickness 205. In FIG. 3, however, intermediate layer 206 has undergone a deformation, and therefore is numbered as intermediate layer 207. The effective thickness 209 of intermediate layer 207 in this actuated or deformed configuration or position may be greater than the effective thickness 205 of intermediate layer 206 in the rest configuration. Because the intermediate layer is bounded on each side, on one side by core 204 and on the other side by cover 208, the change in effective thickness of the intermediate layer may affect the relative position of core 204 and cover 208. In order for intermediate layer 206 to expand and become deformed intermediate layer 207, the deformation may either deform core 204 or cover 208. In some embodiments, the deformation of intermediate layer 207 may compress core 204. In other embodiments, the deformation of intermediate layer 207 may deform and potentially may crack or otherwise create a discontinuity in cover 208. In many embodiments, it is not critical which deformation occurs or what degree of deformation occurs. In many embodiments, as will be described in greater detail below, a slight increase in effective width 209 may be effective to create adequate separation of cover 208 and core 204, thereby facilitating the removal of cover 208 from core 204.

Figure 4:
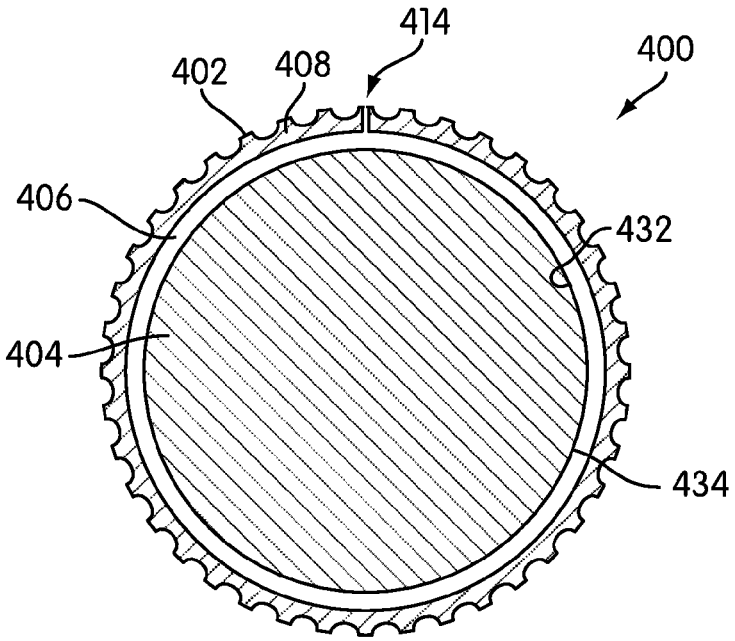
FIG. 4 is a cross-sectional view of a ball using a bladder as an intermediate layer.
Figure 5:
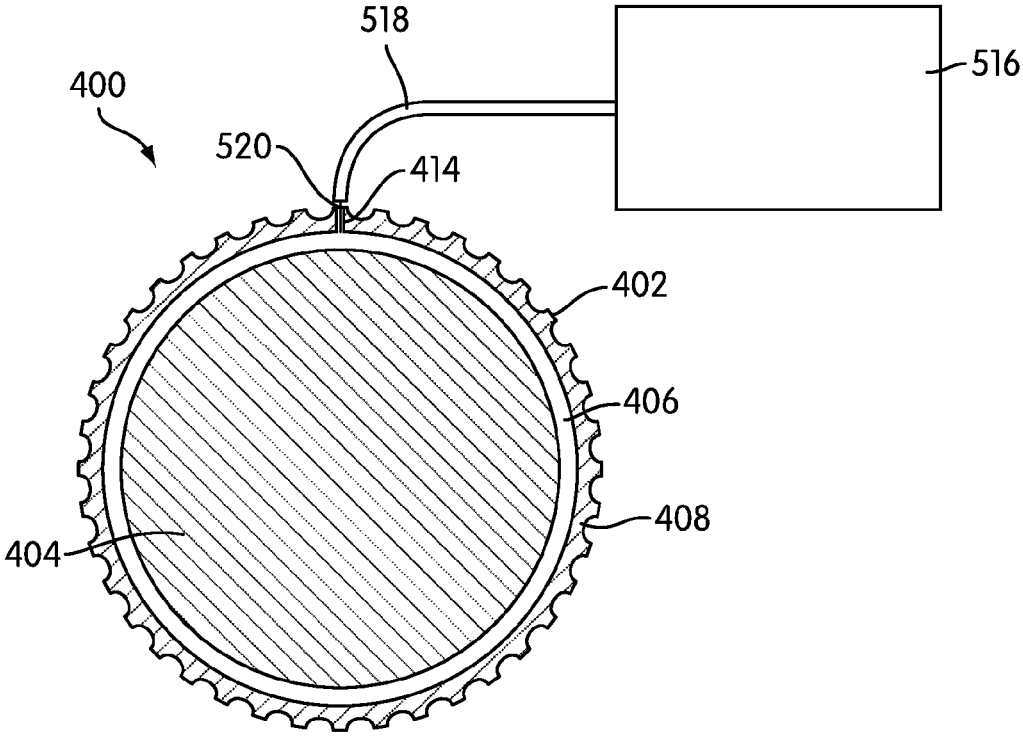
FIG. 5 is a cross sectional view of the ball of FIG. 4 prepared to undergo activation or deformation.

Turning now to FIGS. 4 and 5, another embodiment of an intermediate layer is shown. FIG. 4 shows a ball 400 that may include a core 404, a cover 408, and an intermediate layer 406. Intermediate layer 406 may be positioned radially outwardly of core 402 and cover 408 may be positioned radially outwardly of intermediate layer 406. A port 414 may be positioned on ball 400 and may allow fluid communication between intermediate layer 406 and the outer surface 402 of ball 400.

In some embodiments, port 414 may be configured in a manner similar to a basketball valve. In other embodiments, port 414 may be configured as another type of valve. In many embodiments, it is desirable for port 414 to be a one-way, sealable valve. Because the introduction of one or more fluids into port 414 may initiate cracking of the cover, it may be desirable for port 414 to include a mechanism to keep fluids away from intermediate layer 406 until it is desired to insert the fluid.

In an embodiment with a port 414, intermediate layer 406 may be a bladder or a hydrophilic material. FIG. 5 illustrates in simplified form a structure that may be used to actuate or deform intermediate layer 406. When it is desired to separate core 404 from cover 408, a pump 516 may be attached to port 414. In some instances, pump 516 may be connected to a fluid transmission device 518, such as a tube, which may include a nozzle 520 at its free end. Nozzle 520 may be desirably designed to mate with valve 414 to form a fluid-tight seal. Pump 516 may be any of a variety of types of devices that are capable of injecting a fluid into intermediate layer 406. In some embodiments, the fluid injected into intermediate layer 406 may be a liquid, and in other embodiments, the fluid may be a gas. In some embodiments, the liquid may be water.

In some embodiments, intermediate layer 406 may be a bladder. When intermediate layer 406 is a bladder, it may be desirable for port 414 and nozzle 420 to be configured in a manner similar to other devices used for filling bladders using pumps. For example, port 414 may be configured in a manner similar to inflatable balls, such as basketballs. Such a port is often designed as a rubber or resin cylinder with a relatively small diameter opening. Such a valve may be a one-way valve. In the present disclosure, no fluid is present in the bladder before it is inserted by the pump, and when fluid is inserted, nozzle 520 may fully block port 414. Accordingly, no one-way device may be necessary in many embodiments. In some embodiments, it may be desirable for port 414 to be integrally formed with bladder 406 and that port 414 and bladder 406 be made from resilient materials so that bladder 406 and port 414 are not damaged when the ball 400 is subjected to the typical stresses of play.

The use of a bladder 406 may differ from a typical situation where a bladder is filled with a fluid. While in the context of a basketball or other inflatable ball containing a bladder, the needle shaped nozzle may be positioned anywhere in the interior of the bladder, in the context of a layered ball, there may be no large cavity into which the free end of nozzle 520 would fit. Accordingly, in many embodiments, nozzle 520 may be shaped and sized precisely to extend through cover 408 and to extend only as far as bladder 406. In other embodiments, nozzle 520 may extend only slightly into port 414. In many embodiments, nozzle 520 may be prevented from extending through bladder 406 into core 404, as the injection of fluid into core 404 may be disadvantageous in many embodiments.

Bladder 406 may take one of a variety of forms. Typically, a bladder is a relatively fluid tight compartment that is inflatable with air or another fluid. Examples include such items as inflatable balls, hot water bottles, and even balloons. Many bladders are formed of rubber or another flexible and resilient material that is capable of expanding when fluid is inserted into a cavity within the bladder. However, in some embodiments, bladder 406 need not take such a form.

Figure 6:
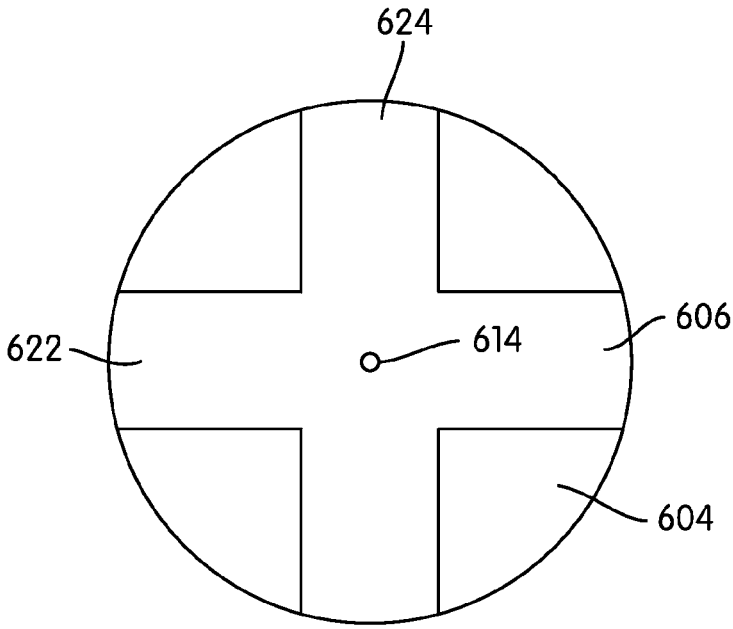
FIG. 6 is a top view of a core and an alternative bladder as an intermediate layer.
Figure 7:
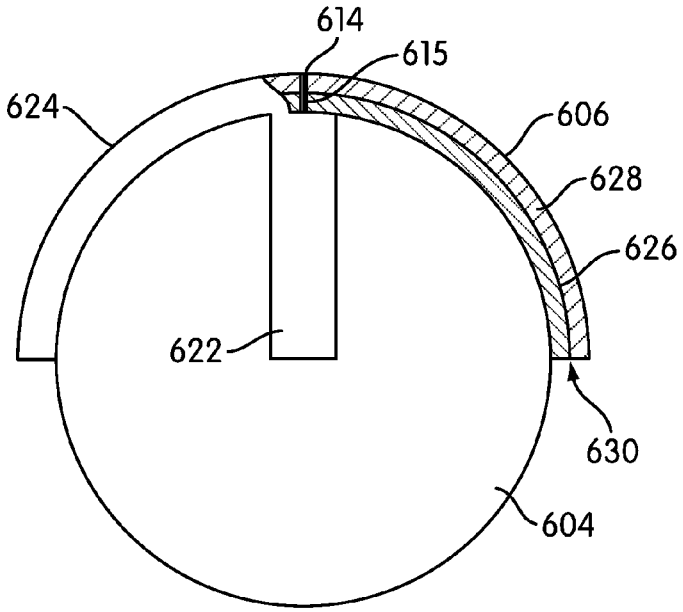
FIG. 7 is a side view of the structure of FIG. 6.

FIGS. 4 and 5 illustrate a bladder 406 that substantially or completely surrounds core 404. However, for ease of manufacturing or for other reasons, bladder 406 may instead take the form of one or a plurality of strips, each of which partially or completely surrounds core 404. FIGS. 6 and 7 illustrate an embodiment of a bladder that includes only strips and that only partially surrounds the core. In FIGS. 6 and 7, intermediate layer or bladder 606 partially surrounds and is positioned radially outwardly from core 604. In FIGS. 6 and 7, intermediate layer 606 has an X-shape and extends about half way around a circumference of core 604. Intermediate layer 606 includes two arms, first arm 622 and second arm 624. Port 614 is integrally formed with intermediate layer 606. FIG. 7 is a side view of the core and intermediate layer of FIG. 6. FIG. 7 is partially in section, showing that the bladder 606 may be formed of an inner layer 626 and an outer layer 628 joined along their peripheral edge 630. In FIGS. 6 and 7, no cover is shown in order to better view the configuration of bladder 606. However, a cover would be added over bladder 606 in use. As is further shown in FIG. 7, port 614 includes a narrow opening 615 into which nozzle 520 may be inserted to insert the fluid between inner layer 626 and outer layer 628. While these details are not shown in FIG. 4, it will be apparent to one of ordinary skill in the art that if a bladder is used in FIG. 4, it will have an inner layer and an outer layer and that the layers may desirably be secured to one another so that the two layers do not rotate relative to one another.

Various configurations of a bladder are, therefore, possible. The bladder may be configured with any number of arms that may completely or partially cover the core. The bladder may have a peripheral edge that is any form of closed curve that partially covers the core. For example, the peripheral edge could be circular and the bladder could form a semi-sphere that covers about a half of the core. Any configuration is possible, depending on any desired cracking pattern and the desires of the designer in creating a ball with desired performance characteristics. While a configuration with four arms is shown, any number of arms may be appropriate and the thickness of the arms may vary from that shown. The example shown is merely one example.

Whether the embodiment of FIGS. 4 and 5 is used or the embodiment of FIGS. 6 and 7 is used, the method of use is substantially the same. Intermediate layer or bladder 406 or intermediate layer or bladder 606 may begin in a rest configuration. A fluid may be introduced into bladder 406 or bladder 606. When the fluid is introduced, it may enter bladder 406 or 606 between an inner ply or layer 626 and outer ply or layer 630, such as is shown in FIG. 7. The introduction of the fluid may cause inner ply 626 and outer ply 630 to separate from one another in the region where fluid is present. This separation is a deformation of intermediate layer 606 from a rest configuration to an actuated configuration, causing a change in the effective thickness of that intermediate layer 606, the thickness increasing because of the thickness of the fluid introduced. In many embodiments, the introduction of the fluid may be more likely to compress core 604 than to deform a cover surrounding intermediate layer 606. As noted above, intermediate layer 406 as shown in FIGS. 4 and 5 may similarly deform and may create an increased thickness of intermediate layer 406 across an entire circumference of core 404. This deformation may place the intermediate layer or bladder in an actuated configuration. This change in thickness may create a separation between the core and the cover in either embodiment, thereby facilitating separation of one from another.

Returning to FIG. 4, in some embodiments, intermediate layer 406 may be a layer of hydrophilic material. A hydrophilic material is one that absorbs water. Other equivalent materials that absorb other fluids may also be used, if it is desired to use a fluid other than water. The term "hydrophilic" is used in the disclosure as short hand for any material that absorbs a fluid, and the term "water" is used in the disclosure as short hand for a fluid that is appropriate for the corresponding material. If a hydrophilic material is used as intermediate layer 406, port 414 may be used to inject water into intermediate layer 406. Many hydrophilic materials are resins that may be easily molded onto core 404 in conventional golf ball molds. Accordingly, intermediate layer 406 may be molded like another layer. However, if a hydrophilic material is used, it may be more complicated or impossible to integrally mold a segment that extends through cover 408 to outer surface 402 to be used like port 414. In such an instance, it may be desirable to include a valve or port 414 that is made of a different material when molding the cover 408. Valve 414 may extend from outer surface 402 to intermediate layer 406. In some embodiments, valve 414 may be a hole drilled into cover 408 when it is desired to actuate or deform intermediate layer 406.

It may be possible in some embodiments for intermediate layer 406 to be a cavity. If intermediate layer 406 is a cavity, it may be desirable for core 404 or cover 408 to include a plurality of spaced fingers to place core 404 and cover 408 in a generally fixed spaced relationship to one another, as in many embodiments, it may be undesirable for core 404 to change in position within ball 400, because such changes in position may adversely affect the flight path of ball 400. In some embodiments, it may be possible for port 414 to simply extend from an outer surface to a desired depth between two golf ball layers and to use those two layers in lieu of the bladder of FIG. 4.

The deformation or activation of intermediate layer 406 is shown in connection with FIG. 5. It will be apparent to one of ordinary skill in the art that in describing intermediate layer 406, an alternative embodiment of intermediate layer 406, such as those described above and those shown in FIGS. 6 and 7 may be used in lieu of the intermediate layer 406. As shown in FIG. 5, pump 516 or other device for injecting a fluid into intermediate layer 406 may be provided. An intermediate tube or conduit 518 may be attached to pump 516 to move the fluid from pump 516 to nozzle 520 and valve 414. In some embodiments, pump 516 may be unnecessary and adequate water pressure may be found, for example, from a public water source. In other embodiments, conduit 518 may be unnecessary. In other embodiments, a specifically designed nozzle 520 may be unnecessary.

The pumping or insertion of the fluid into intermediate layer 406 may cause the expansion of intermediate layer 406. The expansion of intermediate layer 406 may be considered to be deforming intermediate layer 406. As intermediate layer 406 expands and changes in effective thickness due to its activation through the input of a stimulus fluid from nozzle 520, intermediate layer 406 may put inward pressure on core 404 and outward pressure on cover 408. In some embodiments, core 404 may be more compressible than cover 408. In such an embodiment, the deformation of intermediate layer 406 may compress core 404 until the force that is applied on the inward side of intermediate layer 406 by core 404 and the force applied on the outward side of intermediate layer 406 by cover 408 become about equal. Once these two forces become equal, further deformation of the core 404 may become unlikely, and further deformation or expansion of intermediate layer 406 may tend to produce an outward force on cover 408. As the outward force continues, the deformation of intermediate layer 406 may create discontinuities in cover 408. In some embodiments, the creation of such discontinuities may be particularly desirable, and the method may include the step of continuing to insert fluid into intermediate layer 406 until such discontinuities have been created.

The fluid selected to be used in the intermediate layer may have a secondary purpose. The secondary purpose may be to dissolve adhesives. In some embodiments, the various layers of the ball may be secured to one another with an adhesive coating. This adhesive coating is most likely to be present between the core and the cover, and there may be an adhesive coating on each side of the intermediate layer. The presence of adhesive may, in some instances, create complications in recycling one or more layers of the ball. Accordingly, if the fluid chosen is capable of reacting chemically with the adhesive and enhancing the release of the adhesive from the layer or layers to be recycled, the use of such a fluid may be advantageous. For example, and referring again to FIG. 4, if an adhesive that is soluble in water is used on the outside of core 404, a hydrophilic material may be used as intermediate layer 406 and water may be selected as the fluid to be used. As the water is absorbed by intermediate layer 406, some water may be transmitted to inner surface 432 of intermediate layer 406 adjacent outer surface 434 of core 404. The presence of water may tend to dissolve the adhesive from outer surface 434 of core 404 while intermediate layer 406 is undergoing deformation. Accordingly, this selection of fluid may reduce or eliminate a step of removing the adhesive in another, later step. In an alternative embodiment, the fluid used may be acetone or another solvent that may assist in releasing the adhesive.

Figure 9:
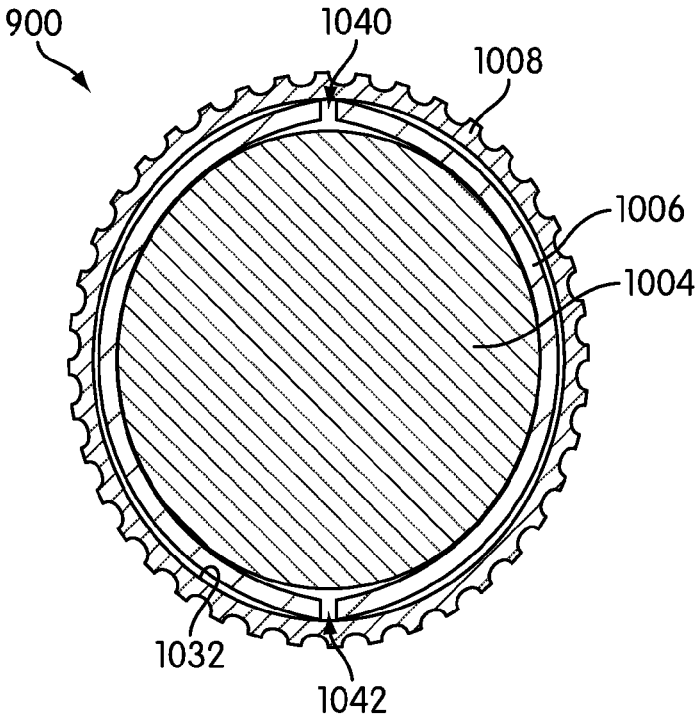
FIG. 9 is a cross-sectional view of the ball of FIG. 8 after undergoing the temperature treatment.

In another embodiment, as shown in FIG. 9, the intermediate layer may be formed of a shape memory material. Shape memory materials are typically formed of a polymer or a wire or metal. However, nanotube-based materials and other materials may also exhibit shape memory characteristics. As a general principle, shape memory materials are ones that have an initial shape, are heated to become thermoplastic and to be molded to have a desired shape. The formed product is then exposed to a stimulus which causes the shape memory material to return to its original shape. The stimulus that causes the return may be heat, light, or electricity, based on the material used. However, as developments in this area are ongoing, when the present disclosure discusses a shape memory material and a stimulus, it intends to encompass all versions of shape memory materials that are meaningful in the present embodiments and all relevant stimuli that actuate or deform the shape memory materials. An example of a thermoplastic shape memory polymer that uses heat as a stimulus is NORSOREX® available from Zeon Chemicals. An example of a shape memory metal is NITINOL, available from NDC in Fremont, Calif. In the context of a golf ball, given the relatively high melt temperatures of the materials used, it may be desirable to use a material that returns to its original shape when heat is applied.

A shape memory polymer or metal may be formed or shaped from an initial, planar shape to conform to the shape of a ball. If a sheet-like material is used, the shape memory material may form an intermediate layer like that shown as intermediate layer 206 of FIG. 2 in a rest configuration. If, instead, strips of shape memory material are used, or if a shape memory metal is made into wire, the wire may be positioned as arms extending partially or fully around the ball. The ball may then be formed in the same manner as in connection with the previously described embodiments.

Figure 8:
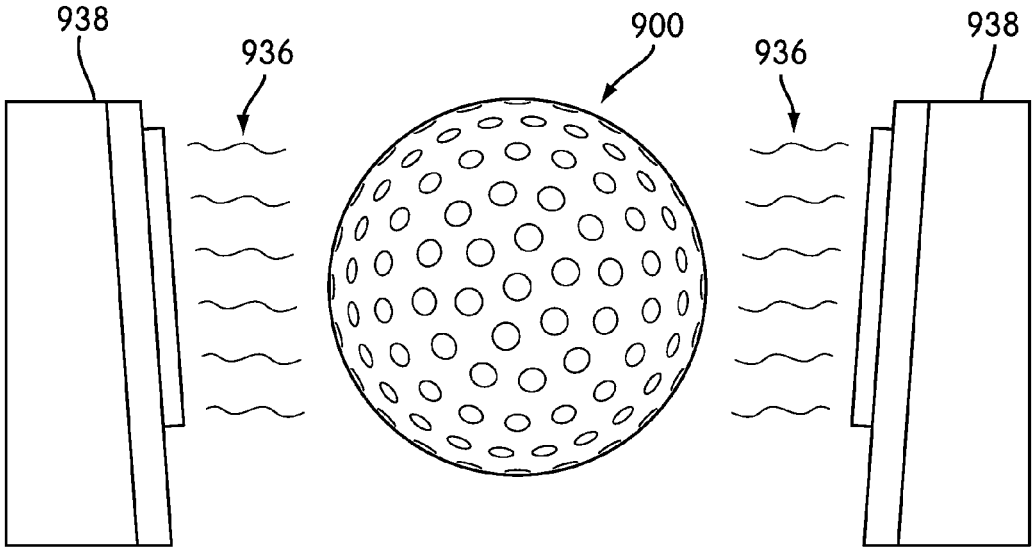
FIG. 8 is a side view of a ball according to the present embodiments being treated with a temperature treatment.

Turning now to FIG. 8, when it is desired to separate the core and cover from one another, ball 900 may be subjected to a stimulus. In FIG. 8, the stimulus is shown as being heat 936 from an oven 938. As noted earlier in the disclosure, the stimulus may be one of a variety of stimuli. Only this stimulus is shown, but any of the stimuli noted or known in the art can be used. When ball 900 is subjected to the stimulus, the intermediate layer may move from its rest configuration to its actuated configuration. The intermediate layer may be actuated or deformed and may return to its original shape. The method of and structure for heating and thermoforming the shape memory material is not shown or described herein, but is well known to people having ordinary skill in the art. The precise method and structure for forming the intermediate layer may vary and still yield the correct functioning of the structures and methods disclosed herein. Accordingly, any conventional method may be used as long as the final product, such as ball 900, functions in the manner herein described and illustrated.

FIG. 9 shows a core 1004 with an intermediate layer 1006 partially surrounding core 1004 and a cover 1008 partially surrounding intermediate layer 1006. Intermediate layer 1006 may be a shape memory polymer or a shape memory metal that has undergone the heat treatment of FIG. 8. In the example shown in FIG. 9, the original shape of the shape memory material may be cylindrical. This shape may not be required, however. In other embodiments, other shapes may be used. For example, in some embodiments, it may be desirable to have an initial shape similar to a FIG. 8 or infinity sign or other desirable shape. In other embodiments, the use of strips or wires of shape memory material may be used. An appropriate shape may vary depending on the precise material used as the shape memory material and its degree of plasticity when it is molded as a layer on ball 1000. For ease of manufacturing in some embodiments, the shape memory material may begin initially as a flat sheet that is then wrapped around a circumference of core 1004 and then is conformed completely to core 1004. However, any desirable manufacturing process may be used.

As shown in FIG. 9, when ball 900 is actuated by or subjected to an appropriate stimulus, such as the heat treatment shown in FIG. 8, intermediate layer 1006 may deform in an effort to return to its original configuration. In the embodiment shown in FIG. 9, the original configuration of intermediate layer 1006 is a cylinder. In many embodiments, the composition and configuration of cover 1008 may be such that intermediate layer 1006 cannot return to its original configuration, as intermediate layer 1006 may not have adequate strength to adequately deform cover 1008 to the degree necessary to return to the original shape of intermediate layer 1006. In such an embodiment, as is shown in FIG. 9, intermediate layer 1006 may deform enough to separate at first edge 1040 and second edge 1042. First edge 1040 and second edge 1042 may press against an inner surface 1032 of cover 1008 and deform cover 1008 to create additional separation between cover 1008 and core 1004. The creation of this gap may be an increase in the effective thickness of the intermediate layer. If such a gap is created, core 1004 may be more easily separated from the remaining layers 1006 and 1008. In some embodiments, cover 1008 may crack upon deformation of intermediate layer 1006.

Figure 10:
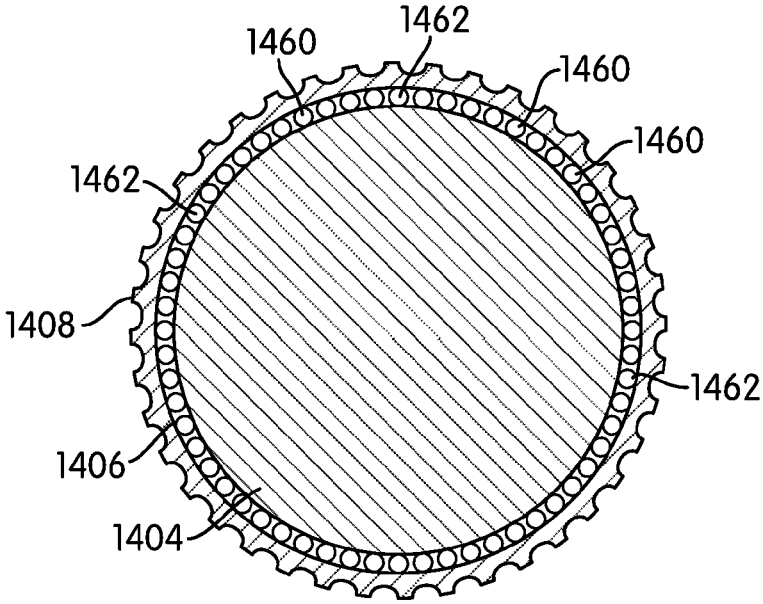
FIG. 10 is a cross-sectional view of another embodiment of a ball according to the present disclosure.

In another embodiment, the parts of the ball itself may create the force that causes the cracking or discontinuity of the cover without the application of a stimulus from outside the ball to actuate or deform the intermediate layer. In the embodiment shown in FIG. 10, there may be again a core 1404, an intermediate layer 1406 surrounding and disposed radially outwardly of core 1404, and a cover 1408 surrounding and disposed radially outwardly of intermediate layer 1406. In this embodiment, intermediate layer 1406 may include two materials. The two materials included in the intermediate layer 1406 may produce a gas when a chemical reaction between the two materials occurs. The gas pressure produced by the gas may create an outward pressure on cover 1408 and may cause a discontinuity or cracking of cover 1408. In FIG. 10, intermediate layer 1406 may include a plurality of capsules. A first subset 1460 of the capsules may be at least partially filled with a first material. A second subset 1462 of the capsules may be at least partially filled with a second material. First subset 1460 may be grouped together and second subset 1462 may be grouped together. Alternatively, and as shown, capsules in first subset 1460 and capsules in second subset 1462 may be interspersed. When at least one capsule of the first subset 1460 breaks and at least one capsule of the second subset 1462 breaks, first material and second material may react with each other. Depending on the materials used, different numbers of each of the first and second subset may need to break in order to create a sufficient pressure to change the effective thickness of intermediate layer 1406 and thereby create a greater separation between core 1404 and cover 1408. This change moves intermediate layer 1406 from its rest configuration to its actuated configuration.

In a relatively non-toxic example, the materials used could be vinegar and baking soda, which form carbon dioxide gas when they react. In some embodiments, ways of separating first material from second material other than by the use of small capsules of each may be useful. For example, the intermediate layer could be separated into two superposed or adjacent layers, each of which contains one of the first material and the second material. In another alternative embodiment, one of the materials may be put into the capsules and the second material may be inserted around the capsules. In some embodiments, these materials may be further surrounded by a bladder with a port similar to that shown above for ease of filling with a liquid material.

In such an embodiment, the actuation of intermediate layer 1406 to deform intermediate layer 1406 and increase the effective thickness of intermediate layer 1406 may be done in a plurality of ways. For example, a force may be applied to ball 1400 that is sufficient to break whatever barrier separates the two materials. This force may be a force applied after ball 1400 is returned for recycling. Alternatively, the capsules or other barrier may be designed to deteriorate over time with repeated strikes to the ball as may be common in golf and other sports. After a certain number of impacts, the capsule or barrier may become weakened in one or a plurality of areas and may open to allow first and second materials to combine. In such a system, the structures and methods described herein may have a further use to deform ball 1400 when it has been struck enough times that its play qualities have deteriorated and it should not be played any longer.

In another embodiment, only first material may form intermediate layer 1406. A port (not shown) similar to that described above in connection with FIGS. 4-7 may be included to extend from intermediate layer 1406 to outer surface 1402 of ball 1400. When it is desired to actuate the intermediate layer, a stimulus in the form of the second material may be injected through the port to start the chemical reaction.

In some embodiments, the materials chosen as first material and second material may be chosen to further accelerate the separation of the core and the cover. The materials may be selected so that one of the materials or one or more of the by-products of the chemical reaction tends to dissolve any adhesive used between the core and cover.

Regardless of the precise configuration used, it may be desirable in some embodiments to be able to predict or control when the chemical reaction will be initiated, particularly if the reaction is likely to occur when the ball is in use by a user.

Once the deformation of the intermediate layer is complete and at least one discontinuity is created on the cover of the ball, regardless of the structure or method disclosed herein used, the recycling process can begin. The separation of the core and cover caused by the increased effective width and deformation of the intermediate layer, in addition to any discontinuity or cracking of the cover can allow the cover and core to be more easily separated from one another than by a typical crushing or grinding that is typically done to separate the core and cover and to remove any adhesive. In this way, the use of the presently disclosed structures and methods may accelerate the recycling process, and in addition may reduce the cost to recycle the ball materials. The use of the disclosed system and method may also assist with the removal of adhesive as an additional feature. Further, the use of some of the methods and structures may assist users in determining when to replace a ball due to deterioration. Accordingly, the present disclosure provides various methods and structures that provide various benefits in manufacturing and use.

The present embodiments relate generally to the use of an intermediate layer that may create separation between a core and a cover of a ball or between two layers of a layered article.

The present embodiments may also be used if it is desired to create a crack or a discontinuity in a layer or cover. Such a configuration and method are described in greater detail in U.S. Patent Application Publication No. 2013/0225322 entitled BALL INCORPORATING ELEMENT FOR CRACKING COVER, filed concurrently herewith, the content of which is incorporated herein by reference. The present embodiments may also be used if it is desired to completely separate a core and a cover or two layers of a layered article. Such a configuration and method are described in greater detail in U.S. Patent Application Publication No. 2013/0225325, entitled BALL INCORPORATING ELEMENT TO REMOVE COVER, filed concurrently herewith, the content of which is incorporated herein by reference.

Although the embodiments discussed herein are limited to golf balls, the invention is not intended to be so limited. The technology described herein may be applicable to any layered article, particularly a projectile, ball, recreational device, or component thereof.

While various embodiments of the invention have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

What is claimed is:

1. A golf ball, comprising: a core; a cover disposed radially outwardly of the core; and an intermediate layer disposed between at least a portion of the cover and at least a portion of the core and having a rest configuration with a rest configuration thickness and an actuated configuration with an actuated configuration thickness, the actuated configuration thickness being greater than the rest configuration thickness, wherein the intermediate layer includes a first material and a second material capable of creating a gas when chemically reacted to obtain the actuated configuration.

2. The golf ball according to claim 1 wherein the intermediate layer substantially completely surrounds the core.

3. A method of preparing a golf ball material for recycling, comprising:

providing a golf ball according to claim 1 and causing the first material and second material to react to create a gas, wherein the gas deforms the intermediate layer to the actuated configuration to minimize the effort required to remove the at least one cover layer from the at least one core layer.

* * * * *